US010269475B2

(12) United States Patent
Ozeki et al.

(10) Patent No.: US 10,269,475 B2
(45) Date of Patent: Apr. 23, 2019

(54) RARE EARTH PERMANENT MAGNET AND METHOD FOR PRODUCING RARE EARTH PERMANENT MAGNET

(71) Applicant: NITTO DENKO CORPORATION, Ibaraki-shi, Osaka (JP)

(72) Inventors: Izumi Ozeki, Ibaraki (JP); Katsuya Kume, Ibaraki (JP); Toshiaki Okuno, Ibaraki (JP); Takashi Ozaki, Ibaraki (JP); Tomohiro Omure, Ibaraki (JP); Keisuke Taihaku, Ibaraki (JP); Takashi Yamamoto, Ibaraki (JP)

(73) Assignee: NITTO DENKO CORPORATION, Ibaraki-shi, Osaka (JP)

( * ) Notice: Subject to any disclaimer, the term of this patent is extended or adjusted under 35 U.S.C. 154(b) by 372 days.

(21) Appl. No.: 15/118,116

(22) PCT Filed: Feb. 12, 2014

(86) PCT No.: PCT/JP2014/053113

§ 371 (c)(1),
(2) Date: Aug. 11, 2016

(87) PCT Pub. No.: WO2015/121914

PCT Pub. Date: Aug. 20, 2015

(65) Prior Publication Data

US 2017/0178773 A1 Jun. 22, 2017

(51) Int. Cl.

| | |
|---|---|
| ***H01F 41/02*** | (2006.01) |
| ***H01F 1/053*** | (2006.01) |
| ***C22C 38/00*** | (2006.01) |
| ***B22F 3/10*** | (2006.01) |
| ***B22F 3/22*** | (2006.01) |
| ***B22F 5/00*** | (2006.01) |
| ***B22F 9/04*** | (2006.01) |
| ***C22C 1/04*** | (2006.01) |
| *H01F 1/057* | (2006.01) |
| *C22C 33/02* | (2006.01) |

(52) U.S. Cl.

CPC ..... *H01F 1/0536* (2013.01); *B22F 3/1021* (2013.01); *B22F 3/22* (2013.01); *B22F 5/006* (2013.01); *B22F 9/04* (2013.01); *C22C 1/0441* (2013.01); *C22C 38/002* (2013.01); *C22C 38/005* (2013.01); *H01F 41/0273* (2013.01); *B22F 2009/041* (2013.01); *B22F 2998/10* (2013.01); *B22F 2999/00* (2013.01); *C22C 33/0278* (2013.01); *C22C 2202/02* (2013.01); *H01F 1/0577* (2013.01)

(58) Field of Classification Search

CPC ..... H01F 1/0536; C22C 1/0441; B22F 9/04; B22F 2009/041; B22F 2998/10; B22F 2999/00

See application file for complete search history.

(56) References Cited

U.S. PATENT DOCUMENTS

| | | | |
|---|---|---|---|
| 8,268,093 | B2 | 9/2012 | Nishiuchi et al. |
| 2012/0306308 | A1 | 12/2012 | Nishiuchi et al. |

FOREIGN PATENT DOCUMENTS

| | | | |
|---|---|---|---|
| JP | 2-173246 | A | 7/1990 |
| JP | 2-266503 | A | 10/1990 |
| JP | 6-77028 | A | 3/1994 |
| JP | 2009-123968 | A | 6/2009 |
| JP | 2013-191611 | A | 9/2013 |
| WO | 2007/135981 | A1 | 11/2007 |

OTHER PUBLICATIONS

International Search Report of PCT/JP2014/053113 dated May 13, 2014.

*Primary Examiner* — Jessee R Roe
(74) *Attorney, Agent, or Firm* — Sughrue Mion, PLLC

(57) ABSTRACT

Provided are a rare-earth permanent magnet whose magnet density after sintering is very high and a method for manufacturing a rare-earth permanent magnet. Thus, a magnet raw material is milled into magnet powder, and then, a compound 12 is formed by mixing the magnet powder thus milled with a binder. Next, the compound 12 thus formed is subjected to a hot-melt molding onto a supporting substrate 13 so as to form a green sheet 14 molded to a sheet-like shape. Thereafter, while the green sheet 14 thus molded is softened by heating, magnetic field orientation is carried out by applying a magnetic field to the green sheet 14 thus heated; and further, the green sheet 14 having been subjected to the magnetic field orientation is calcined by a vacuum sintering, which is further followed by a pressure sintering to produce a permanent magnet 1.

16 Claims, 9 Drawing Sheets

FIG. 9

| | Sintering condition | Degree of orientation | Density | Residual magnetic flux density Br [T] | Coercive force Hcj [kOe]] |
|---|---|---|---|---|---|
| Example 1 | Comparative Example 1 added with pressure sintering | 98% | 99% | 1.34 | 9.1 |
| Example 2 | Comparative Example 2 added with pressure sintering | 97% | 99% | 1.34 | 11 |
| Example 3 | Comparative Example 3 added with pressure sintering | 97% | 99% | 1.35 | 11 |
| Comparative Example 1 | Only pressureless sintering | 98% | 97% | 1.27 | 8.7 |
| Comparative Example 2 | Only pressureless sintering | 97% | 98% | 1.31 | 9.9 |
| Comparative Example 3 | Only pressureless sintering | 97% | 99% | 1.33 | 11 |

RARE EARTH PERMANENT MAGNET AND METHOD FOR PRODUCING RARE EARTH PERMANENT MAGNET

CROSS REFERENCE TO RELATED APPLICATIONS

This application is a National Stage of International Application No. PCT/JP2014/053113 filed Feb. 12, 2014, the contents of which are incorporated herein by reference in its entirety.

TECHNICAL FIELD

The present invention relates to a rare-earth permanent magnet, and a method for manufacturing a rare-earth permanent magnet.

BACKGROUND ART

In recent years, a decrease in size and weight, an increase in power output, and an increase in efficiency have been needed in a permanent magnet motor used in a hybrid car, a hard disk drive, and so forth. To realize such a decrease in size and weight, an increase in power output, and an increase in efficiency in the permanent magnet motor mentioned above, film-thinning and a further improvement in magnetic properties have been needed for a permanent magnet to be embedded in the motor.

As to a method for manufacturing a permanent magnet to be used in a permanent magnet motor, a powder sintering method has been generally used. In this powder sintering method, first, a raw material is milled by a jet mill or the like (dry-milling method) to produce magnet powder. Thereafter, the resulting magnet powder is put in a mold and pressed to mold to a desired shape. Then, the magnet powder molded to the desired shape in a solid state is sintered at a prescribed temperature (for example, at 1100° C. for the case of Nd—Fe—B-based magnet) for completion (See, for example, Japanese Laid-Open Patent Application Publication No. 2-266503). In addition, in order to improve magnetic properties of a permanent magnet, magnetic field orientation is generally carried out by applying a magnetic field from outside. In the method for manufacturing a permanent magnet by a conventional powder sintering method, magnet powder is filled into a mold at the time of press molding; and then, a pressure is applied after a magnet field is applied thereto to carry out the magnetic field orientation so as to mold the magnet powder to a shaped body of compressed powder. In other method for manufacturing a permanent magnet such as an extrusion molding method, an injection molding method, and a roll molding method, a magnet has been molded by applying a pressure under the atmosphere in which a magnetic field is applied. By so doing, a shaped body having direction of the axis of easy magnetization of each magnet particle constituting the permanent magnet aligned in a direction of an applied magnetic field can be formed.

PRIOR ART DOCUMENT

Patent Document

Patent document 1: Japanese Laid-Open Patent Application Publication No. 2-266503 (page 5)

DISCLOSURE OF THE INVENTION

Problem to be Solved by the Invention

As a reason for causing deterioration in magnetic properties of the magnet, formation of spaces inside the magnet may be mentioned. In order to avoid these spaces, high densification of the magnet (full-densification) after sintering is important. However, full-densification of the magnet after sintering could not have been realized by a conventional sintering method.

The present invention was made in order to solve the above-mentioned problem in the past, and thus, an object of the present invention is to provide: a rare-earth permanent magnet whose magnetic properties are improved by full-densification of a permanent magnet after sintering, wherein such a full-densification is realized by sintering a shaped body by a pressureless sintering, which is then followed by a pressure sintering; and a method for manufacturing a rare-earth permanent magnet.

Means for Solving the Problems

To achieve the above object, the rare-earth permanent magnet according to the present invention is characterized by that the rare-earth permanent magnet is manufactured by a method including: milling a magnet raw material into magnet powder; forming a shaped body by molding the magnet powder thus milled; carrying out magnetic field orientation to the shaped body by applying a magnetic field; sintering the shaped body thus orientated in a magnetic field by a pressureless sintering; and sintering further a sintered body, which is the shaped body sintered by the pressureless sintering, by a pressure sintering with a pressure being applied in a perpendicular direction to an applied magnetic field direction.

Also, the rare-earth permanent magnet according to the present invention is the rare-earth permanent magnet of claim 1 which is characterized by that in the step of sintering the sintered body by a pressure sintering, the sintering is made by a uniaxial pressure sintering.

Also, the rare-earth permanent magnet according to the present invention is characterized by that in the step of sintering the sintered body by a pressure sintering, the sintering is made by an electric current sintering.

Also, the rare-earth permanent magnet according to the present invention is characterized by that density of the rare-earth permanent magnet sintered by the pressure sintering is 95% or more.

Also, the rare-earth permanent magnet according to the present invention is characterized by that before the pressureless sintering of the shaped body, the shaped body is calcined under a non-oxidizing atmosphere to remove carbons in the shaped body.

Also, the rare-earth permanent magnet according to the present invention is characterized by that in the step of calcining the shaped body, after a temperature of the shaped body is raised to a predetermined temperature under a non-oxidizing atmosphere with a temperature rising rate of 2° C./minute or less, the shaped body is kept at the predetermined temperature for a certain period of time.

Also, the rare-earth permanent magnet according to the present invention is characterized by that in the step of molding the magnet powder to a shaped body, a mixture of the magnet powder with a binder is formed, and then, the mixture is molded to a sheet-like shape to produce a green sheet as the shaped body.

Also, the rare-earth permanent magnet according to the present invention is characterized by that in the step of molding the magnet powder to a shaped body, the magnet powder is molded to the shaped body by a powder compaction molding.

Also, the method for manufacturing a rare-earth permanent magnet according to the present invention includes: milling a magnet raw material into magnet powder; forming a shaped body by molding the magnet powder thus milled; carrying out magnetic field orientation to the shaped body by applying a magnetic field; sintering the shaped body thus orientated in a magnetic field by a pressureless sintering; and sintering further a sintered body, which is the shaped body sintered by the pressureless sintering, by a pressure sintering with a pressure being applied in a perpendicular direction to an applied magnetic field direction.

Also, the method for manufacturing a rare-earth permanent magnet according to the present invention is characterized by that in the step of sintering the sintered body by a pressure sintering, the sintering is made by a uniaxial pressure sintering.

Also, the method for manufacturing a rare-earth permanent magnet according to the present invention is characterized by that in the step of sintering the sintered body by a pressure sintering, the sintering is made by an electric current sintering.

Also, the method for manufacturing a rare-earth permanent magnet according to the present invention is characterized by that density of the rare-earth permanent magnet sintered by the pressure sintering is 95% or more.

Also, the method for manufacturing a rare-earth permanent magnet according to the present invention is characterized by that before the pressureless sintering of the shaped body, the shaped body is calcined under a non-oxidizing atmosphere to remove carbons in the shaped body.

Also, the method for manufacturing a rare-earth permanent magnet according to the present invention is characterized by that in the step of calcining the shaped body, after a temperature of the shaped body is raised to a predetermined temperature under a non-oxidizing atmosphere with a temperature rising rate of 2° C./minute or less, the shaped body is kept at the predetermined temperature for a certain period of time.

Also, the method for manufacturing a rare-earth permanent magnet according to the present invention is characterized by that in the step of molding the magnet powder to a shaped body, a mixture of the magnet powder with the binder is formed, and then, the mixture is molded to a sheet-like shape to produce a green sheet as the shaped body.

Also, the method for manufacturing a rare-earth permanent magnet according to the present invention is characterized by that in the step of molding the magnet powder to a shaped body, the magnet powder is molded to the shaped body by a powder compaction molding.

Effect of the Invention

According to the rare-earth permanent magnet of the present invention with the above-mentioned embodiments, because after the shaped body is sintered by a pressureless sintering the shaped body is sintered again by a pressure sintering, the density of the permanent magnet after sintering can be made very high (full densification). In addition, at the time of the pressure sintering, a pressure is applied in a perpendicular direction to an applied magnetic field direction, so that application of the pressure to the sintered body does not cause any change in direction of the C-axis (axis of easy magnetization) of the magnet particles after orientation. As a consequence, there is no risk of decrease in the degree of orientation, so that deterioration of magnetic properties can be prevented from occurring as well.

Also, according to the rare-earth permanent magnet of the present invention, in the step of sintering the sintered body by a pressure sintering, the sintering is made by a uniaxial pressure sintering thereby leading to uniform contraction by sintering, so that deformation such as warpage and depression after sintering can be prevented from occurring. In addition, decrease in the degree of orientation can also be prevented from occurring.

Also, according to the rare-earth permanent magnet of the present invention, in the step of sintering the sintered body by a pressure sintering, the sintering is made by an electric current sintering, so that rapid heating and cooling are possible, and in addition, the sintering can be made in a low temperature range. As a result, the time of the temperature rise and the retention time thereof can be made short, so that a compact sintered body with suppressed grain growth of the magnet particles can be produced.

Also, according to the rare-earth permanent magnet of the present invention, if the density of the rare-earth permanent magnet is made 95% or more, spaces are not formed inside the magnet, so that a large decrease in the magnetic properties due to the spaces can be prevented from occurring.

Also, according to the rare-earth permanent magnet of the present invention, even if the calcination process is carried out in the shaped body for decarbonization, the density of the permanent magnet after sintering can be made high.

Also, according to the rare-earth permanent magnet of the present invention, because after a temperature of the shaped body is raised to a predetermined temperature under a non-oxidizing atmosphere with a temperature rising rate of 2° C./minute or less, the shaped body is calcined by keeping it at the predetermined temperature for a certain period of time, the carbons contained in the shaped body can be gradually removed in accordance with a slow temperature change. As a consequence, the rare-earth permanent magnet having high density can be produced without forming many spaces inside the magnet.

Also, according to the rare-earth permanent magnet of the present invention, because the permanent magnet is composed of the magnet which is obtained by mixing the magnet powder with the binder and then sintering the molded green sheet, the sintering can be made with uniform contraction so that deformation such as warpage and depression do not take place after sintering; and moreover, pressure is not applied unevenly in the pressing process, so that there is no necessity of having a mending process which has been conventionally needed after sintering; and therefore, the manufacturing process can be made simple. As a consequence, the permanent magnet can be molded with a high size accuracy.

Also, according to the rare-earth permanent magnet of the present invention, even in the case that the magnet powder is molded by the powder compaction molding, the density of the permanent magnet after sintering can be made high.

Also, according to the method for manufacturing a rare-earth permanent magnet of the present invention, because after the shaped body is sintered by a pressureless sintering the shaped body is sintered again by a pressure sintering, the density of the permanent magnet after sintering can be made high (full densification). In addition, at the time of the pressure sintering, a pressure is applied in a perpendicular direction to an applied magnetic field direction, so that application of the pressure to the sintered body does not cause any change in direction of the C-axis (axis of easy magnetization) of the magnet particles after orientation. As a consequence, there is no risk of decrease in the degree of orientation, so that deterioration of magnetic properties can also be prevented from occurring.

Also, according to the method for manufacturing a rare-earth permanent magnet of the present invention, in the step of sintering the sintered body by a pressure sintering, the sintering is made by a uniaxial pressure sintering thereby leading to uniform contraction by sintering, so that deformation such as warpage and depression after sintering can be prevented from occurring. In addition, decrease in the degree of orientation can also be prevented from occurring.

Also, according to the method for manufacturing a rare-earth permanent magnet of the present invention, in the step of sintering the sintered body by a pressure sintering, the sintering is made by an electric current sintering, so that rapid heating and cooling are possible, and in addition, the sintering can be made in a low temperature range. As a result, the time of the temperature rise and the retention time thereof can be made short, so that a compact sintered body with suppressed grain growth of the magnet particles can be produced.

Also, according to the method for manufacturing a rare-earth permanent magnet of the present invention, if the density of the rare-earth permanent magnet is made 95% or more, spaces are not formed inside the magnet, so that a large decrease in the magnetic properties due to the spaces can be prevented from occurring.

Also, according to the method for manufacturing a rare-earth permanent magnet of the present invention, even if the calcination process is carried out in the shaped body for decarbonization, the density of the permanent magnet after sintering can be made high.

Also, according to the method for manufacturing a rare-earth permanent magnet of the present invention, because after a temperature of the shaped body is raised to a predetermined temperature under a non-oxidizing atmosphere with a temperature rising rate of 2° C./minute or less, the shaped body is calcined by keeping it at the predetermined temperature for a certain period of time, the carbons contained in the shaped body can be gradually removed in accordance with a slow temperature change. As a consequence, the rare-earth permanent magnet having high density can be produced without forming many spaces inside the magnet.

Also, according to the method for manufacturing a rare-earth permanent magnet of the present invention, because the permanent magnet is composed of the magnet which is obtained by mixing the magnet powder with the binder and then sintering the molded green sheet, the sintering can be made with uniform contraction so that deformation such as warpage and depression do not take place after sintering; and moreover, pressure is not applied unevenly in the pressing process, so that there is no necessity of having a mending process which has been conventionally needed after sintering; and therefore, the manufacturing process can be made simple. As a consequence, the permanent magnet can be molded with a high size accuracy.

Also, according to the method for manufacturing a rare-earth permanent magnet of the present invention, even in the case that the magnet powder is molded by the powder compaction molding, the density of the permanent magnet after sintering can be made high.

BRIEF DESCRIPTION OF THE DRAWINGS

FIG. 9 is the table illustrating various measurement results of each magnet in Examples and Comparative Examples.

BEST MODE FOR CARRYING OUT THE INVENTION

Specific embodiments of the rare-earth permanent magnet and the method for manufacturing a rare-earth permanent magnet according to the present invention will be described below in detail with reference to the drawings.

[Constitution of Permanent Magnet]

Figure 1:
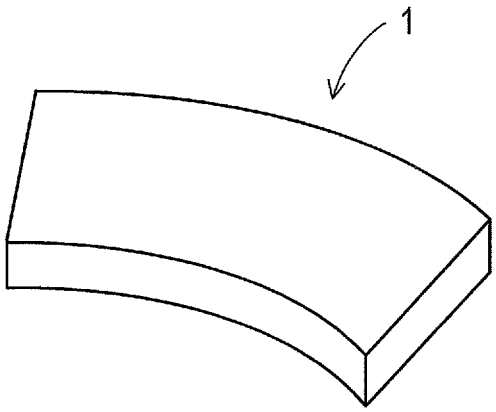
FIG. 1 is an overall view of a permanent magnet according to the present invention.

First, a constitution of a permanent magnet 1 according to the present invention will be described. FIG. 1 is an overall view of the permanent magnet 1 according to the present invention. Meanwhile, the permanent magnet 1 depicted in FIG. 1 has a fan-like shape; however, the shape of the permanent magnet 1 can be changed according to the shape of a cutting-die.

The permanent magnet 1 according to the present invention is an Nd—Fe—B-based anisotropic magnet. Meanwhile, the contents of respective components are regarded to be 27 to 40% by weight for Nd, 0.8 to 2% by weight for B, and 60 to 70% by weight for Fe (electrolytic iron). Furthermore, the permanent magnet 1 may contain other elements such as Dy, Tb, Co, Cu, Al, Si, Ga, Nb, V, Pr, Mo, Zr, Ta, Ti, W, Ag, Bi, Zn or Mg in small quantities so as to improve the magnetic properties thereof. FIG. 1 is an overall view of the permanent magnet 1 according to the present embodiment.

The permanent magnet 1 as used herein is a permanent magnet in a thin film shape having, for example, a thickness of 0.05 to 10 mm (for example, 1 mm). The permanent magnet 1 is produced by sintering a shaped body formed by a later-described powder compaction molding or a shaped body formed by molding a mixture of magnet powder with a binder (green body). The green body is prepared by molding the later-mentioned mixture (slurry or compound) of magnet powder with a binder to a prescribed shape (for example, a sheet-like shape, a block-like shape, a shape of a final product, or the like). Meanwhile, an embodiment may also be allowed that the mixture is molded once to a shape other than that of a final product followed by processing it into a shape of the final product through punching, cutting, deforming, or the like. Especially, an embodiment that the mixture is once molded to a sheet-like shape followed by processing it to a shape of the final product can improve not only productivity by using a continuous production process but also molding accuracy. In the case that the mixture is molded to a sheet-like shape, a sheet member in the shape of a thin film having thickness of, for example, in the range of 0.05 to 10 mm (for example, 1 mm) is prepared. Meanwhile, even in the case of the sheet-like shape, by laminating plural pieces of the sheet, the permanent magnet 1 with a large size may also be manufactured.

In the present invention, especially in the case that the permanent magnet 1 is manufactured by sintering the green body, for the binder to be mixed with the magnet powder, a resin, a long-chain hydrocarbon, a fatty acid ester, a mixture thereof, or the like is used.

Further, in the case that a resin is used for the binder, the resin to be used is preferably a polymer having no oxygen atom in its structure and being capable of depolymerization. In order to reuse a residual matter which is left over after the later-mentioned mixture of the magnet powder with the binder is molded to a shape of a final product, and also in order to carry out the magnetic field orientation of the molded mixture in a softened state by heating, a thermoplastic resin is used. Specifically, the resin belonging to this is a polymer or a copolymer of one or more kinds of monomers selected from monomers represented by the following general formula (1), provided that R1 and R2 each in the formula represent a hydrogen atom, a lower alkyl group, a phenyl group, or a vinyl group.

[Chem. 1]

Illustrative example of the polymer satisfying the above condition includes polyisobutylene (PIB; polymer of isobutylene), polyisoprene (isoprene rubber or IR; polymer of isoprene), polybutadiene (butadiene rubber or BR; polymer of 1,3-butadiene), polystyrene (polymer of styrene), styrene-isoprene block copolymer (SIS; copolymer of styrene and isoprene), butyl rubber (IIR; copolymer of isobutylene and isoprene), styrene-butadiene block copolymer (SBS; copolymer of styrene and butadiene), poly(2-methyl-1-pentene) (polymer of 2-methyl-1-pentene), poly(2-methyl-1-butene) (polymer of 2-methyl-1-butene), and poly(α-methylstyrene) (polymer of α-methylstyrene). Meanwhile, a low molecular weight polyisobutylene is preferably added to the poly(α-methylstyrene) to render flexibility thereto. Also, an embodiment may also be allowed that the resin to be used for the binder contains small quantities of a polymer or a copolymer of an oxygen-containing monomer (such as poly(butyl methacrylate) and poly(methyl methacrylate)). Further, a monomer not satisfying the above general formula (1) may be partially copolymerized thereto. Even in such a case, the purpose of the present invention can be realized.

Meanwhile, in order to suitably carry out the magnetic field orientation, the binder is preferably made of a thermoplastic resin that softens at 250° C. or lower, or more specifically, a thermoplastic resin whose glass transition point or melting point is 250° C. or lower.

On the other hand, in the case that a long-chain hydrocarbon is used for the binder, a long-chain saturated hydrocarbon (long-chain alkane), which is a solid at room temperature and a liquid at a temperature higher than room temperature, is preferably used. Specifically, a long-chain saturated hydrocarbon having 18 or more carbon atoms is preferably used. At the time when the later-mentioned mixture of the magnet powder with the binder is subjected to the magnetic field orientation, the magnetic field orientation is carried out under a state where the mixture is softened by heating the mixture at a temperature higher than the melting point of the long-chain hydrocarbon.

Likewise, in the case that a fatty acid ester is used for the binder, methyl stearate, methyl docosanoate, or the like, these being a solid at room temperature and a liquid at a temperature higher than room temperature, is preferably used. At the time when the later-mentioned mixture of the magnet powder with the binder is subjected to the magnetic field orientation, the magnetic field orientation is carried out under a state where the mixture is softened by heating the mixture at a temperature equal to or higher than the melting point of the fatty acid ester.

By using a binder that satisfies the above condition as the binder to be mixed with the magnet powder, the carbon content and oxygen content in the magnet can be reduced. Specifically, the carbon content remaining in the magnet after sintering is made 2000 ppm or less, while more preferably 1000 ppm or less. Also, the oxygen content remaining in the magnet after sintering is made 5000 ppm or less, while more preferably 2000 ppm or less.

Further, the amount of the binder to be added may be an appropriate amount to fill the spaces among magnet particles so as to improve the thickness accuracy of the shaped body at the time when the slurry or the compound molten by heating is molded. For example, the ratio of the binder to the total amount of the magnet powder and the binder is preferably in the range of 1 to 40% by weight, more preferably in the range of 2 to 30% by weight, while still more preferably in the range of 3 to 20% by weight.

[Method for Manufacturing Permanent Magnet]

Figure 2:
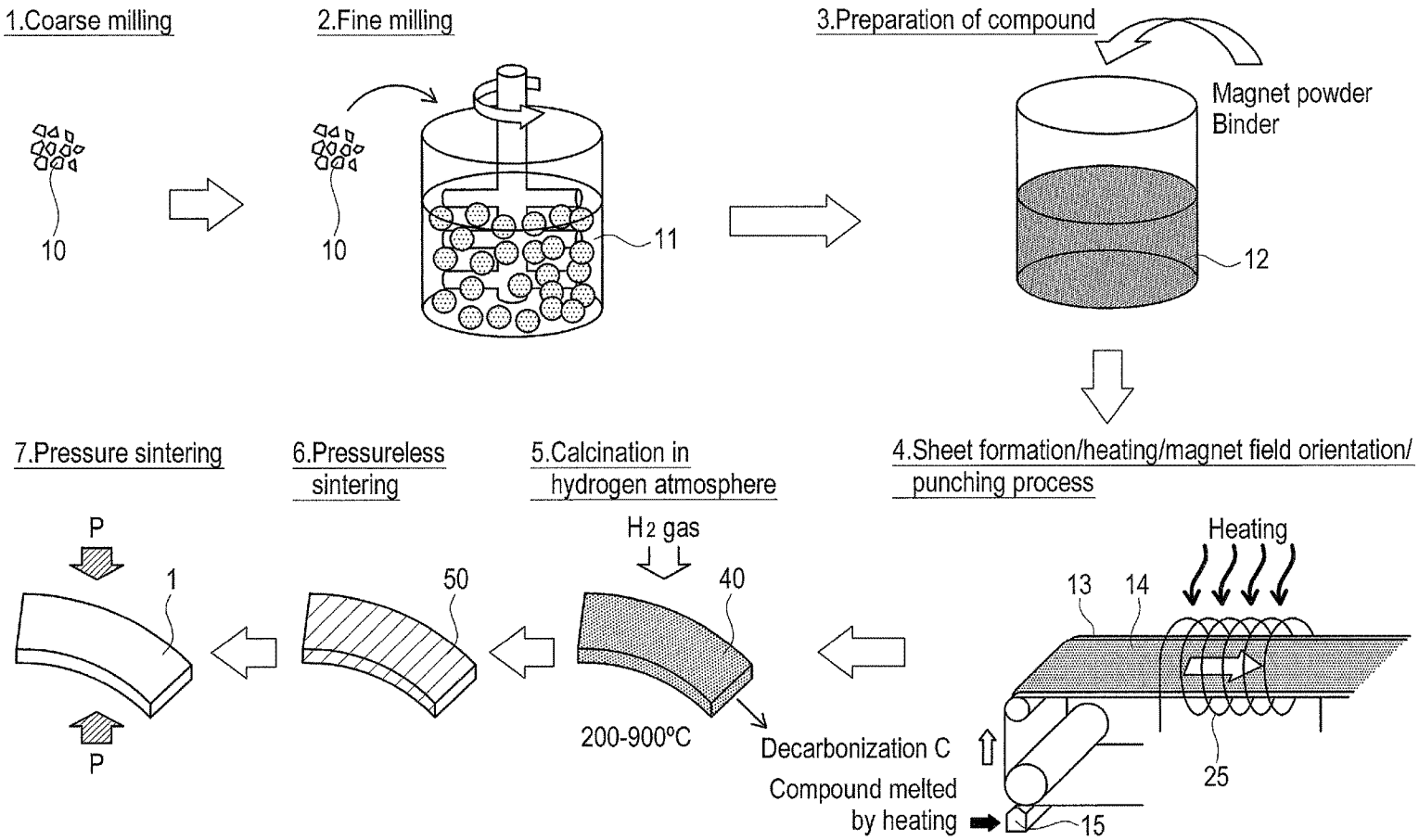
FIG. 2 is an explanatory diagram illustrating the manufacturing process of a permanent magnet according to the present invention.

Next, the method for manufacturing the permanent magnet 1 according to the present invention will be described below with reference to FIG. 2. FIG. 2 is an explanatory view illustrating the manufacturing process of the permanent magnet 1 according to the present invention.

First, an ingot including Nd—Fe—B with a prescribed fraction (for example, Nd: 32.7% by weight, Fe (electrolytic iron): 65.96% by weight, and B: 1.34% by weight) is prepared. Thereafter, the ingot is coarsely milled by using a stamp mill, a crusher, or the like to a size of approximately 200 μm. Alternatively, the ingot is melted, formed into flakes by using a strip-casting method, and then coarsely milled by using a hydrogen pulverization method. By so doing, coarsely milled magnet powder 10 can be obtained.

Next, the coarsely milled magnet powder 10 is finely milled by a wet method using a bead mill 11, or a dry method using a jet mill, or the like. For example, in fine milling using a wet method with the bead mill 11, the coarsely milled magnet powder 10 is finely milled to a particle size of within a prescribed range (for example, in the range of 0.1 to 5.0 μm) in a solvent whereby dispersing the magnet powder into the solvent. Thereafter, the magnet powder contained in the solvent after the wet milling is dried by such a method as vacuum drying to obtain the dried magnet powder. The solvent to be used in the milling is not particularly restricted, wherein illustrative example of the solvent that can be used includes alcohols such as isopropyl alcohol, ethanol, and methanol; esters such as ethyl acetate; lower hydrocarbons such as pentane and hexane; aromatics such as benzene, toluene, and xylene; ketones; and a mixture thereof. Meanwhile, it is preferable to use a solvent not containing an oxygen atom therein.

On the other hand, in fine milling using the dry method with a jet mill, the coarsely milled magnet powder is finely milled with the jet mill in: (a) an atmosphere including an inert gas such as a nitrogen gas, an argon (Ar) gas, a helium (He) gas, or the like, wherein an oxygen content therein is substantially 0%; or (b) an atmosphere including an inert gas such as a nitrogen gas, an Ar gas, a He gas, or the like, wherein an oxygen content therein is in the range of 0.0001 to 0.5%, to form fine powder whose average particle diameter is within a prescribed range (for example, in the range of 0.7 to 5.0 μm). Meanwhile, the term "an oxygen content therein is substantially 0%" is not limited to a case where the oxygen content is completely 0%, but may include a case where oxygen is contained in such an amount as to allow formation of an oxide film only faintly on the surface of the fine powder.

Next, the magnet powder finely milled by the bead mill 11 or the like is molded to a desired shape. Meanwhile, molding of the magnet powder is carried out by such methods as a powder compaction molding method in which molding to a desired shape is made by using a die and a green body molding method in which the mixture of the magnet powder with the binder is molded to a desired shape. Further, in the powder compaction molding, there are a dry method in which a dried fine powder is filled in a cavity and a wet method in which a slurry containing magnet powder is filled in a cavity without drying. On the other hand, in the green body molding, the mixture may be molded directly to a shape of a final product, or the mixture is once molded to a shape other than a shape of a final product, which then followed by the magnetic field orientation, and thereafter, the shape of the final product may be obtained by processing with punching, cutting, deforming, or the like. In examples illustrated below, the mixture is once molded to a sheet-like shape (hereinafter, this is referred to as a green sheet), and then this sheet is processed to the shape of the final product. In the case that the mixture is molded especially to the sheet-like shape, there may be molding methods for it such as: a hot-melt coating method in which a compound, i.e., a mixture of the magnet powder with the binder, is prepared and then followed by molding this compound to a sheet-like shape after it is heated; a slurry coating method in which a slurry containing the magnet powder, the binder, and an organic solvent is applied onto a substrate thereby molding to a sheet-like shape; and the like.

Hereinafter, the green sheet molding using the hot-melt coating method will be specifically explained.

First, a binder is mixed with the magnet powder which is finely milled by the bead mill 11 or the like thereby obtaining a powdery mixture (compound) 12 including the magnet powder and the binder. Here, as mentioned before, a resin, a long-chain hydrocarbon, a fatty acid ester, a mixture thereof, or the like is used as the binder. For example, in the case that a resin is used, it is preferable to use a thermoplastic resin including a polymer which is capable of depolymerization and is a polymer of monomers not having an oxygen atom; and in the case that a long-chain hydrocarbon is used, it is preferable to use a long-chain saturated hydrocarbon (long-chain alkane) which is a solid at room temperature and a liquid at a temperature higher than room temperature. In the case that a fatty acid ester is used, methyl stearate, methyl docosanoate, or the like is preferably used. Here, the amount of the binder to be added is preferably such that the ratio of the binder to the total amount of the magnet powder and the binder in the compound 12 after the addition as mentioned before may be in the range of 1 to 40% by weight, more preferably in the range of 2 to 30% by weight, while still more preferably in the range of 3 to 20% by weight.

In addition, in order to improve a degree of orientation in the later step of the magnetic field orientation, an additive to facilitate the orientation may be added to the compound 12. An illustrative example of the additive to facilitate the orientation is a hydrocarbon-based additive, wherein the use of a polar additive (specifically the acid dissociation constant pKa of less than 41) is especially preferable. Addition amount of the additive is dependent on the particle diameter of the magnet powder, wherein more amount thereof is needed with smaller particle diameter of the magnet powder. Specifically, the addition amount relative to the magnet powder is preferably in the range of 0.1 to 10 parts by mass, while more preferably in the range of 1 to 8 parts by mass. The additive that is added to the magnet powder attaches to surface of the magnet particle, whereby playing a role to facilitate a rotation movement of the magnet particle in the later-mentioned magnetic field orientation process. As a result, the orientation takes place easily at the time when the magnetic field is applied, so that the axis of easy magnetization of each magnet particle can be aligned in the same direction (namely, a higher degree of orientation can be obtained). Especially in the case that the binder is added to the magnet powder, because the binder is present on the particle surface, a friction force during the orientation becomes larger thereby leading to decrease in orientation of the particles; and therefore, the effect of adding the additive is enhanced furthermore.

Meanwhile, addition of the binder is carried out under an atmosphere including an inert gas such as a nitrogen gas, an Ar gas, and a He gas. Meanwhile, mixing of the magnet powder with the binder is carried out, for example, by adding the magnet powder and the binder each into a stirring equipment whereby stirring them with a stirrer. Alternatively, in order to facilitate kneading, the stirring may be carried out with heating. Further, it is preferable to carry out the mixing of the magnet powder with the binder under an atmosphere including an inert gas such as a nitrogen gas, an Ar gas, and a He gas. Especially in the case that the magnet powder is obtained by milling with a wet method, an embodiment may be allowed that without taking out the magnet powder from a solvent used in the milling, the binder is added to the solvent, which is followed by kneading the resulting mixture and then evaporating the solvent from it, thereby the compound 12 to be mentioned later is obtained.

Next, a green sheet is prepared from the compound 12 by molding it to a sheet-like shape. Especially in the hot-melt coating method, the compound 12 is melted by heating the compound 12 to make it a fluid state, which is then followed by coating onto a supporting substrate 13 such as a separator. Thereafter, it is allowed to be cooled for solidification to form the green sheet 14 in the long sheet-like shape on the supporting substrate 13. Meanwhile, although the temperature of heating the compound 12 for melting is dependent on the kind and amount of the binder to be used, the temperature is in the range of 50 to 300° C. However, the temperature needs to be higher than a melting point of the binder to be used. Meanwhile, in the case that the slurry coating method is used, the magnet powder and the binder (in addition, the additive to facilitate the orientation may also be added thereto) are dispersed into a large amount of an organic solvent, and then the resulting slurry is coated onto the supporting substrate 13 such as a separator. Thereafter, the organic solvent is evaporated by drying, resulting in formation of the green sheet 14 in the long sheet-like shape on the supporting substrate 13.

Here, as to the coating method of the molten compound 12, a method having excellent controllability of the layer thickness, such as a slot-die method and a calendar roll method, is preferable. Especially in order to realize high thickness accuracy, a die method or a comma coating method, both having excellent controllability of the layer thickness (namely, the method with which a layer having high thickness accuracy can be coated on the substrate surface), is preferably used. For example, in the slot-die method, the compound 12 melted to a fluid state by heating is extruded by a gear pump to put into the die thereby performing the coating. In the calendar roll method, a prescribed amount of the compound 12 is charged into a gap between two heated rolls, and the compound 12 melted by the heat of the rolls is coated onto the supporting substrate 13 with rotating the rolls. As to the supporting substrate 13, for example, a silicone-treated polyester film is used. Further, it is preferable to carry out a defoaming treatment thoroughly by using a defoaming agent, or by a heat and vacuum defoaming method, or the like, so that air bubbles may not remain in a developing layer. Further, instead of coating onto the supporting substrate 13, an embodiment may also be allowed that while being molded to a sheet-like shape by using an extrusion molding or an injection molding, the compound 12 melted is extruded onto the supporting substrate 13 thereby molding it to the green sheet 14 on the supporting substrate 13.

Figure 3:
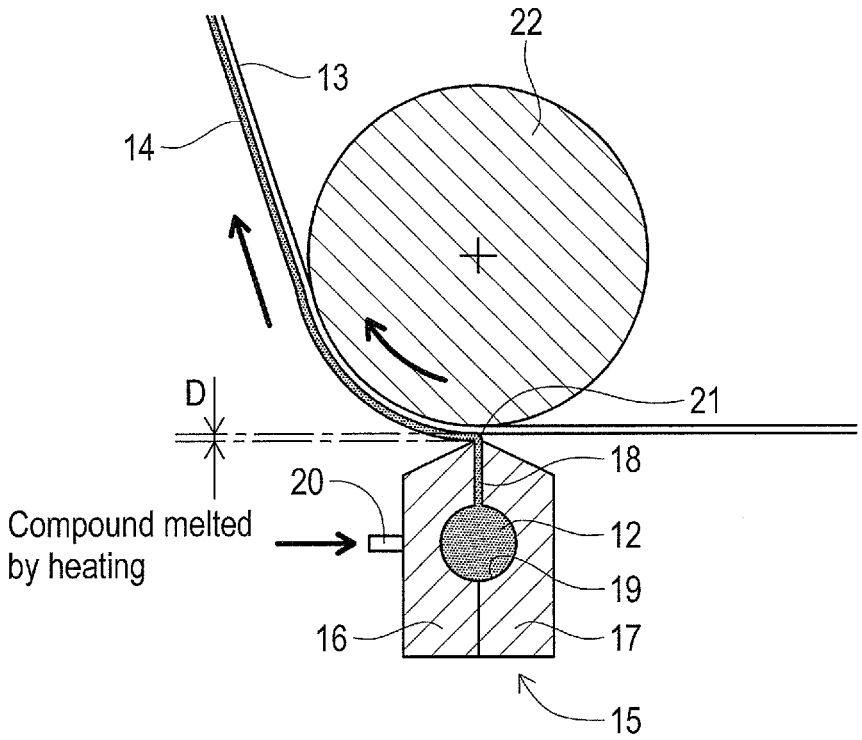
FIG. 3 is an explanatory diagram specifically illustrating the molding process of the green sheet in the manufacturing process of a permanent magnet according to the present invention.

Hereunder will be given a detailed description of the formation process of the green sheet 14 by using a slot-die method with referring to FIG. 3. FIG. 3 is an explanatory diagram illustrating the formation process of the green sheet 14 by using the slot-die method.

As illustrated in FIG. 3, a slot die 15 used for the slot-die method is formed by putting blocks 16 and 17 together thereby forming a slit 18 and a cavity (liquid pool) 19 by a space between the blocks 16 and 17. The cavity 19 communicates with an inlet port 20 formed in the block 17. Further, the inlet port 20 is connected to a coating fluid feed system configured with the gear pump and so forth (not illustrated), and the cavity 19 receives a feed of the compound 12 in a fluid state through the inlet port 20 metered by means of a metering pump or the like. Further, the compound 12 in a fluid state fed to the cavity 19 is delivered to the slit 18, and discharged with a predetermined coating width from an outlet port 21 of the slit 18 with a uniform pressure in transverse direction and with a constant amount per unit time. Meanwhile, the supporting substrate 13 is continuously conveyed with the rotation of a coating roll 22 at a predetermined speed. As a result, the compound 12 in a fluid state discharged is laid down onto the supporting substrate 13 with a prescribed thickness. Thereafter, the compound 12 is allowed to stand for cooling and solidifying thereby forming the green sheet 14 in the long sheet-like shape on the supporting substrate 13.

Further, in the formation process of the green sheet 14 by the slot-die method, it is preferable to measure the actual sheet thickness of the green sheet 14 after coating, thereby performing, on the basis of the measured thickness, the feedback control of a gap D between the slot die 15 and the supporting substrate 13. Further, it is preferable to minimize the variation in the feed rate of the compound 12 in a fluid state supplied to the slot die 15 (for example, to suppress the variation within plus or minus 0.1%), and in addition, to also minimize the variation in the coating speed (for example, to suppress the variation within plus or minus 0.1%). As a result, thickness accuracy of the green sheet 14 can further be improved. Meanwhile, the thickness accuracy of the green sheet 14 thereby formed is within a margin of error of plus or minus 10% relative to a designed value (for example, 1 mm), preferably within plus or minus 3%, while more preferably within plus or minus 1%. Alternatively, in the calendar roll method, the film thickness of the compound 12 transferred onto the supporting substrate 13 can be controlled by controlling the calendaring conditions according to an actual measurement value.

Meanwhile, a predetermined thickness of the green sheet 14 is preferably in the range of 0.05 to 20 mm. If the thickness is predetermined to be thinner than 0.05 mm, it needs to laminate many layers, which lowers the productivity.

Next, the magnetic field orientation is carried out to the green sheet 14 on the supporting substrate 13 formed by the above-mentioned hot-melt coating method. Specifically, to begin with, the green sheet 14 conveyed together with the supporting substrate 13 is softened by heating. Specifically, the softening is carried out until the green sheet 14 reaches the viscosity of in the range of 1 to 1500 Pa·s, while more preferably in the range of 1 to 500 Pa·s. By so doing, the magnetic field orientation can be carried out properly.

Meanwhile, the appropriate temperature and duration for heating the green sheet 14 differ depending on the type or amount of the binder, but can be tentatively set, for example, at 100 to 250° C., and 0.1 to 60 minutes, respectively. However, for the purpose of softening the green sheet 14, the temperature needs to be equal to or higher than the glass transition point or melting point of the binder to be used. Further, the heating method for heating the green sheet 14 may be such a method as heating by a hot plate, or heating using a heating medium (silicone oil) as a heat source. Next, the magnetic field orientation is carried out by applying a magnetic field in an in-plane and machine direction of the green sheet 14 having been softened by heating. The intensity of the applied magnetic field is in the range of 5000 to 150000 [Oe], while preferably in the range of 10000 to 120000 [Oe]. As a result, the C-axis (axis of easy magnetization) of each magnet crystal contained in the green sheet 14 is aligned in one direction. Meanwhile, the application direction of the magnetic field may also be an in-plane and transverse direction of the green sheet 14. Alternatively, an embodiment that the magnetic field is simultaneously applied to plural pieces of the green sheet 14 may also be allowed.

Further, when the magnetic field is applied to the green sheet 14, an embodiment that the magnetic field is applied simultaneously with the heating, or the magnetic field is applied after the heating and before the green sheet 14 solidifies may also be allowed. Alternatively, an embodiment that the magnetic field is oriented before the green sheet 14 formed by the hot-melt coating solidifies may also be allowed. In such a case, the heating process is not needed.

Figure 4:
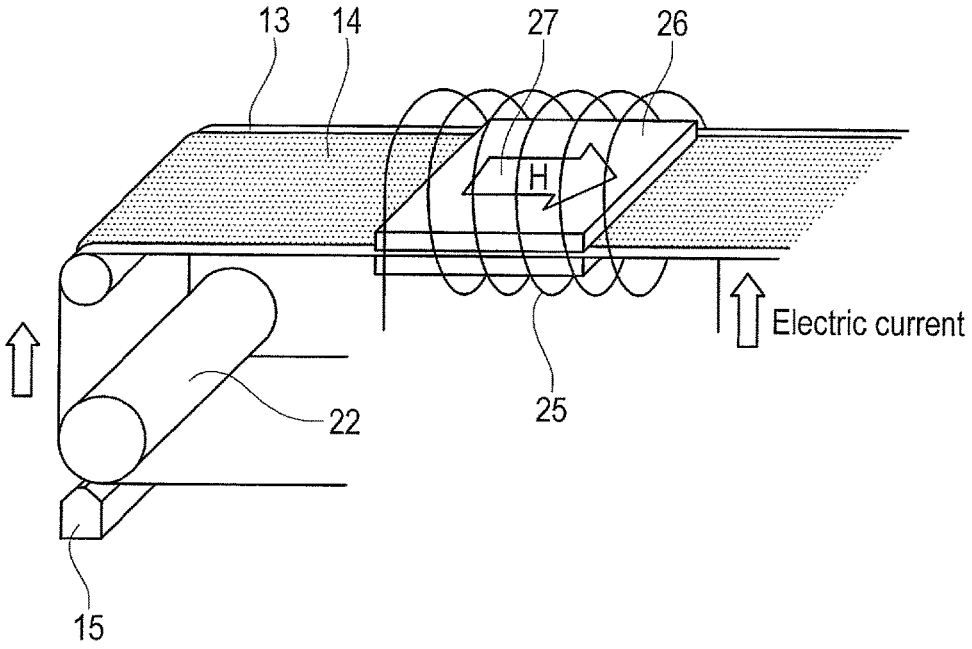
FIG. 4 is an explanatory diagram specifically illustrating the heating process and the magnetic field orientation process of the green sheet in the manufacturing process of a permanent magnet according to the present invention.

Next, the heating process and the magnetic field orientation process of the green sheet 14 will be explained in more detail with referring to FIG. 4. FIG. 4 is an explanatory diagram illustrating the heating process and the magnetic field orientation process of the green sheet 14. Meanwhile, with referring to FIG. 4, an explanation will be made as to the example wherein the heating process and the magnetic field orientation process are carried out simultaneously.

As depicted in FIG. 4, the heating and the magnetic field orientation to the green sheet 14 having been coated by the above described slot-die method are carried out to the green sheet 14 in the long sheet-like shape which is in the continuously conveyed state by a roll. That is, apparatuses for the heating and the magnetic field orientation are arranged in the downstream side of a coating apparatus (such as a slot-die apparatus) so as to perform the heating and the magnetic field orientation subsequent to the coating process.

Specifically, a solenoid 25 is arranged in the downstream side of the slot die 15 and the coating roll 22 so that the green sheet 14 and the supporting substrate 13 being conveyed together may pass through the solenoid 25. Further, inside the solenoid 25, hot plates 26 are arranged as a pair on upper and lower sides of the green sheet 14. While heating the green sheet 14 by the hot plates 26 arranged as a pair on the upper and lower sides, electric current is applied to the solenoid 25 thereby generating a magnetic field in an in-plane direction (i.e., direction parallel to a sheet surface of the green sheet 14) as well as a machine direction of the green sheet 14 in the long sheet-like shape. Thus, the green sheet 14 continuously conveyed is softened by heating, and at the same time the magnetic field (H) is applied to the green sheet 14 thus softened in the in-plane and machine direction of the green sheet 14 (direction of the arrow 27 in FIG. 4), so that the magnetic field orientation can be carried out on the green sheet 14 appropriately and uniformly. Especially, application of the magnetic field in the in-plane direction thereof can prevent surface of the green sheet 14 from bristling up.

Further, the green sheet 14 after the magnetic field orientation process is preferably cooled and solidified under the state of being conveyed, for the sake of higher efficiency in the manufacturing process.

Meanwhile, in the case that the magnetic field orientation is made in an in-plane and transverse direction of the green sheet 14, an embodiment is made such that the solenoid 25 may be replaced with a pair of magnetic coils arranged on the right and left sides of the green sheet 14 under the state of being conveyed. Through energizing both magnetic coils, a magnetic field can be generated in an in-plane and transverse direction of the green sheet 14 in the long sheet-like shape.

Figure 5:
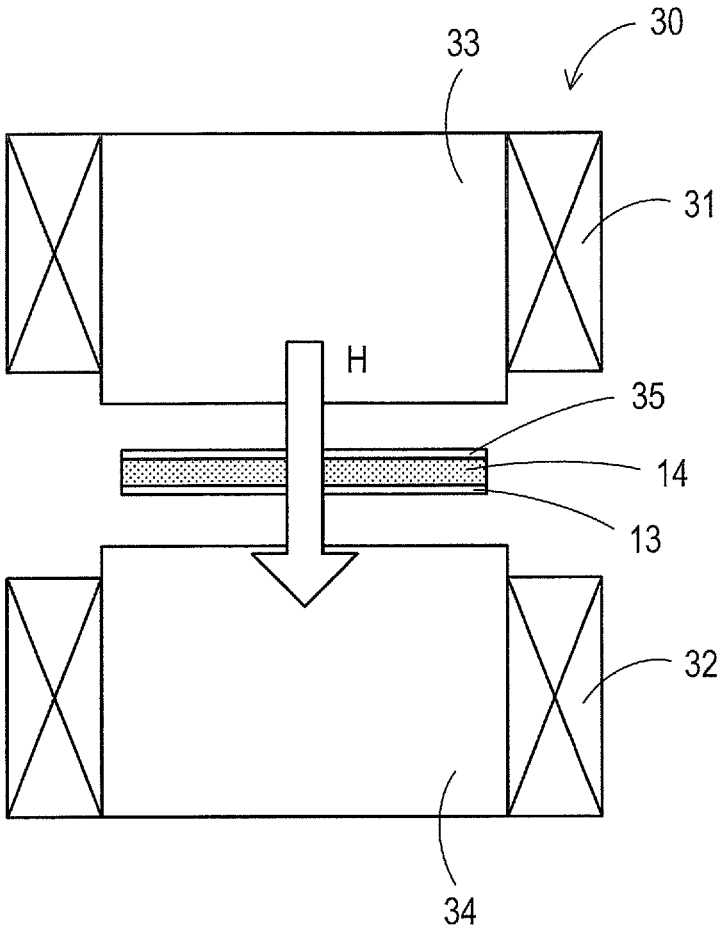
FIG. 5 is a diagram illustrating an example of the magnetic field orientation in a direction perpendicular to a plane of the green sheet.

Further, the magnetic field orientation may also be made in a direction perpendicular to a plane of the green sheet 14. In the case that the magnetic field orientation is made in the direction perpendicular to a plane of the green sheet 14, for example, a magnetic field application apparatus using pole pieces or the like may be used. Specifically, as illustrated in FIG. 5, a magnetic field application apparatus 30 using pole pieces or the like has two coil portions 31 and 32 in the ring-like shape which are arranged in parallel with each other and coaxially aligned, as well as two pole pieces 33 and 34 almost in the column-like shape which are arranged inside ring holes of the coil portions 31 and 32, respectively, wherein the magnetic field application apparatus 30 is arranged so as to have a prescribed clearance to the green sheet 14 under the state of being conveyed. The coil portions 31 and 32 are energized to generate a magnetic field in the direction perpendicular to the plane of the green sheet 14 to carry out the magnetic field orientation of the green sheet 14 by supplying current to the coil portions 31 and 32. Meanwhile, in the case that the magnetic field orientation is made in the direction perpendicular to the plane of the green sheet 14, it is preferable to laminate a film 35 on the surface opposite to the supporting substrate 13 that is laminated to the green sheet 14, as depicted in FIG. 5. By so doing, the surface of the green sheet 14 can be prevented from bristling up.

Figure 6:
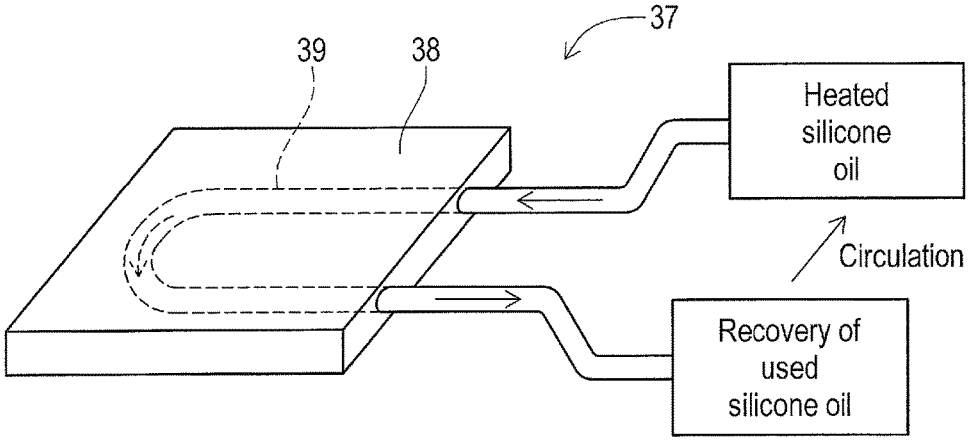
FIG. 6 is an explanatory diagram illustrating a heating device using a heating medium (silicone oil).

Further, instead of the heating method that uses the hot plates 26 as mentioned above, a heating method that uses a heating medium (silicone oil) as a heat source may be used as well. FIG. 6 is an explanatory diagram illustrating a heating device 37 using the heating medium.

As depicted in FIG. 6, an embodiment is made that the heating device 37 has, as a heater element, a flat plate member 38 having a channel 39 almost in the U-shape formed inside thereof, thereby circulating silicone oil heated to a prescribed temperature (for example, in the range of 100 to 300° C.) inside the channel 39, as the heating medium. Then, in place of the hot plates 26 illustrated in FIG. 4, the heating devices 37 are arranged inside the solenoid 25 as a pair on the upper and lower sides of the green sheet 14. By so doing, the green sheet 14 being continuously conveyed is heated and softened via the flat plate member 38 which is made hot by the heating medium. Meanwhile, the flat plate member 38 may make direct contact with the green sheet 14, or may be arranged so as to have a prescribed clearance to the green sheet 14. Then, a magnetic field is applied to the green sheet 14 in an in-plane and machine direction thereof (direction of arrow 27 in FIG. 4) by the solenoid 25 arranged around the green sheet 14 thus softened, so that the magnetic field orientation can be made on the green sheet 14 appropriately and uniformly. Meanwhile, a heating device 37 using the heating medium as depicted in FIG. 6 does not have an internal electric heating cable like a general hot plate 26; and accordingly, even arranged inside a magnetic field, there is no risk that the heating device 37 induces a Lorentz force which may cause vibration or breakage of the electric heating cable, so that the green sheet 14 can be heated appropriately. Further, a heat control by electric current may involve a problem that the ON or OFF of the power source causes the electric heating cable to vibrate, resulting in fatigue fracture thereof. However, such a problem can be resolved by using the heating device 37 with a heating medium as a heat source.

Here, instead of employing the hot-melt molding method, in the case that the green sheet 14 is formed by a conventional slot-die method or a doctor blade method using a liquid material having high fluidity such as slurry, when the green sheet 14 is conveyed into the place where there is a magnetic field gradient, the magnet powder contained in the green sheet 14 is attracted to a stronger magnetic field, thereby leading to a risk of liquid localization of the slurry destined to form the green sheet 14, i.e., a risk of imbalance in the thickness of the green sheet 14. In contrast, in the case that the hot-melt molding method is employed for molding the compound 12 to the green sheet 14 as in the present invention, the viscosity of the compound 12 reaches several tens to hundreds of thousand Pa·s at a temperature near a room temperature, so that there is no localization of the magnet powder during the time when the green sheet 14 is passing through the magnetic field gradient. Further, the viscosity of the binder therein becomes lower as the green sheet 14 is conveyed into a homogenous magnetic field and heated therein, and therefore, the uniform C-axis orientation becomes attainable merely by the rotary torque in the homogeneous magnetic field.

Further, in the case that the green sheet 14 is molded by using a liquid material having high fluidity such as an organic solvent-containing slurry by a conventional slot-die method or a doctor blade method, instead of employing the hot-melt molding method, if a sheet having the thickness of more than 1 mm is going to be formed, problematic bubbles may be formed during a drying process by evaporation of the organic solvent contained in the slurry or the like. Further, if the duration of the drying process is extended in order to suppress bubbles, the magnet powder is caused to be separated, resulting in an imbalanced density distribution of the magnet powder in the gravity direction, which in turn may cause warpage of the permanent magnet after sintering. Accordingly, in the molding from the slurry, the maximum thickness is virtually restricted; and therefore, the green sheet 14 needs to be thin with the thickness of 1 mm or less and to be laminated thereafter. However, in such a case, the binder cannot be sufficiently intermingled, which causes interlayer-delamination in the subsequent binder removal process (calcination process), leading to degradation in the orientation in the C-axis (axis of easy magnetization), namely, causing to decrease in the residual magnetic flux density (Br). In contrast, in the case that the compound 12 is molded to the green sheet 14 by using the hot-melt molding method as in the present invention, because the compound 12 does not contain an organic solvent, there is no risk of such bubbles as mentioned above, even if a sheet having the thickness of more than 1 mm is prepared. Further, because the binder is well intermingled, there is no risk of the interlayer-delamination in the binder removal process.

Further, in the case that plural pieces of the green sheet 14 are simultaneously exposed to the magnetic field, for example, an embodiment may be allowed that the plural pieces of the green sheet 14 laminated in multiple layers (for example, six layers) are continuously conveyed whereby the laminated multiple layers of the green sheet 14 are made to pass through inside the solenoid 25. By so doing, the productivity can be improved.

Then, the green sheet 14 having been orientated in the magnetic field is punched into a desired product shape (for example, a fan-like shape as depicted in FIG. 1) to form a shaped body 40.

Thereafter, the shaped body 40 thus molded is kept at a decomposition temperature of the binder (if an additive to facilitate the orientation is added, this temperature also needs to satisfy the condition that it is equal to or higher than a decomposition temperature of the additive) for several hours to several tens of hours (for example, five hours) in a non-oxidizing atmosphere (especially in the present invention, a hydrogen atmosphere or a mixed gas atmosphere of hydrogen and an inert gas) at a normal atmospheric pressure, or a pressure higher or lower than the normal atmospheric pressure (for example, 1.0 Pa or 1.0 MPa), thereby the calcination process is carried out. In the case that the calcination is carried out in a hydrogen atmosphere, the hydrogen feed rate during the calcination is made, for example, 5 L/minute. By carrying out the calcination, organic compounds including the binder can be decomposed by a depolymerization reaction into monomers, which can be scatteringly removed therefrom. That is, so-called decarbonization is carried out with which carbon content in the shaped body 40 can be reduced. Furthermore, the calcination is carried out under such a condition that carbon content in the shaped body 40 may become 2000 ppm or less, while more preferably 1000 ppm or less. By so doing, it becomes possible to densely sinter the entirety of the permanent magnet 1 in the subsequent sintering process, so that there is no decrease in the residual magnetic flux density or in the coercive force. Furthermore, in the case that the calcination is carried out under the pressure condition of higher than an atmospheric pressure, the pressure is preferably 15 MPa or lower. Meanwhile, the pressure condition of higher than an atmospheric pressure, more specifically the pressure of 0.2 Mpa or higher, especially contributes to reduce the carbon content.

Meanwhile, the decomposition temperature of the binder is determined on the basis of the analysis results of the binder decomposition products and decomposition residues. Specifically, the temperature is selected from such a range that when the binder decomposition products are trapped, no decomposition products except monomers are formed and no products due to the side reaction of residual binder components are detected in the analysis of the residues. The temperature differs depending on the type of binder, but may be set in the range of 200 to 900° C., while more preferably in the range of 400 to 600° C. (for example, 450° C.).

Figure 7:
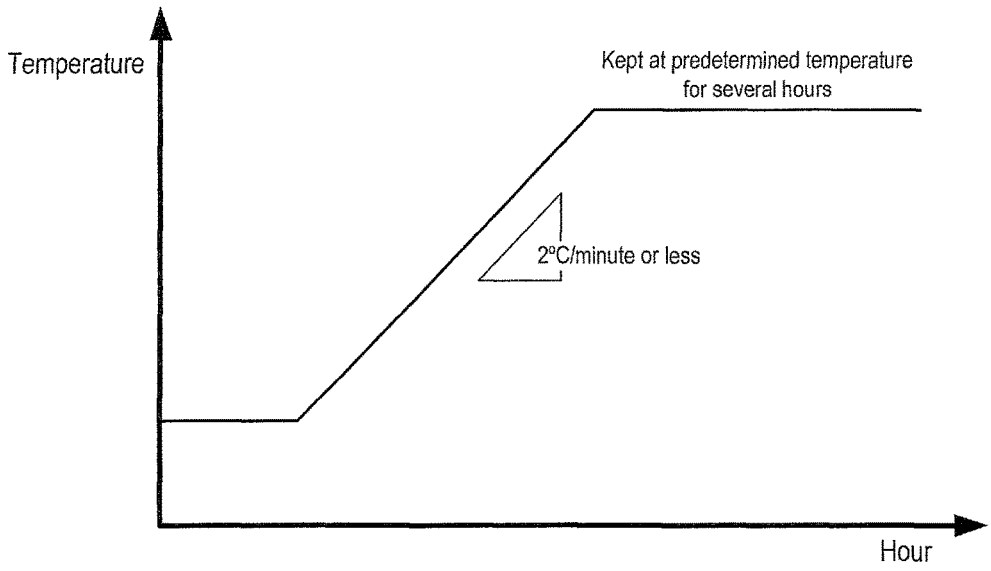
FIG. 7 is an explanatory diagram specifically illustrating the temperature rising embodiment in the manufacturing process of a permanent magnet according to the present invention.

In addition, the calcination is carried out preferably at a slower temperature rising rate as compared with a general magnet sintering process. Specifically, the temperature rising rate is 2° C./minute or less (for example, 1.5° C./minute). Therefore, in the case that the calcination is carried out, the calcination is carried out in the way as depicted in FIG. 7, that is, the temperature is raised at the prescribed temperature rising rate of 2° C./minute or less, and after the temperature reaches a predetermined set temperature (decomposition temperature of the binder), the shaped body is kept at the set temperature for several hours to tens of hours. When the temperature rising rate in the calcination process is made slow as mentioned above, the carbons in the shaped body 40 are not removed too rapidly but removed gradually; and thus, the density of the permanent magnet after sintering can be made higher (namely, the spaces in the permanent magnet can be made less). And, if the temperature rising rate of 2° C./minute or less is selected, the density of 95% or more is attainable in the permanent magnet after sintering, so that high magnet properties can be expected.

Further, thereafter, dehydrogenation may be carried out by keeping in a vacuum atmosphere the shaped body 40 calcined in the calcination process. In the dehydrogenation process, $NdH_3$ (having high activity, formed in the calcination process) in the shaped body 40 is gradually changed from $NdH_3$ (having high activity) to $NdH_2$ (having low activity), so that the activity of the shaped body 40, which is activated by the calcination process, decreases. Accordingly, even if the shaped body 40 calcined by the calcination process is later moved into an atmosphere, Nd therein is prevented from combining with oxygen, so that there is no decrease in the residual magnetic flux density or in the coercive force. In addition, an effect may be expected that the crystal structure of the magnet is put back to the structure of $Nd_2Fe_{14}B$ from those of $NdH_2$ and the like.

Thereafter, a pressureless sintering is carried out in which the shaped body 40 calcined by the calcination process is sintered pressurelessly. Specifically, without applying a pressure to the shaped body 40, the temperature is raised in a vacuum atmosphere to the sintering temperature of around 800 to 1080° C. with a prescribed temperature rising rate, and then this temperature is kept for approximately 0.1 to 2.0 hours. During this period, there occurs the vacuum sintering, wherein the degree of vacuum is preferably 5 Pa or less, while more preferably $10^{-2}$ Pa or less. As a result of the sintering, a shaped body of the sintered magnet (hereunder, this is referred to as sintered body 50) is obtained.

Next, the sintered body 50 which is sintered by a pressureless sintering is further subjected to a pressure sintering thereby carrying out the pressure sintering thereof. Meanwhile, a direction of the pressure in the pressure sintering is made perpendicular to the direction of the applied magnetic field (for example, in-plane and machine direction of the green sheet). That is, the pressure is applied in a perpendicular direction to the C-axis (axis of easy magnetization) of the magnet particles which have been orientated by the magnetic field orientation process. The pressure sintering may include a hot pressure sintering, a hot isostatic pressure (HIP) sintering, an ultrahigh pressure synthesis sintering, a gas pressure sintering, and a spark plasma (SPS) sintering. However, it is preferable to adopt the spark plasma sintering which is a uniaxial pressure sintering in which pressure is uniaxially applied and also in which sintering is carried out by an electric current sintering in order to suppress grain growth of the magnet particles during the sintering and also to suppress warpage to be formed in the magnets after sintering. Meanwhile, in the case that the sintering is carried out by the SPS sintering, preferably, the pressure value is set, for example, in the range of 0.01 to 100 MPa, and the temperature is raised to approximately 940° C. at the rate of 10° C./minute under a vacuum atmosphere with the pressure of not higher than several Pa, and then kept there for five minutes. The shaped body 40 is then cooled down, and again subjected to a heat treatment in the temperature range of 300 to 1000° C. for two hours. As a result of the sintering, the permanent magnet 1 is manufactured. In the present invention, by carrying out the pressure sintering as described above, the density of the permanent magnet can be made higher than that of before the pressure sintering (namely, the spaces among the permanent magnet can be made smaller). Especially, if the density of the permanent magnet after sintering is made 95% or higher, better magnetic properties can be expected. In addition, when the temperature rising rate in the calcination process is made 2° C./minute or less as mentioned above, the density of the permanent magnet after sintering can be made further high.

Figure 8:
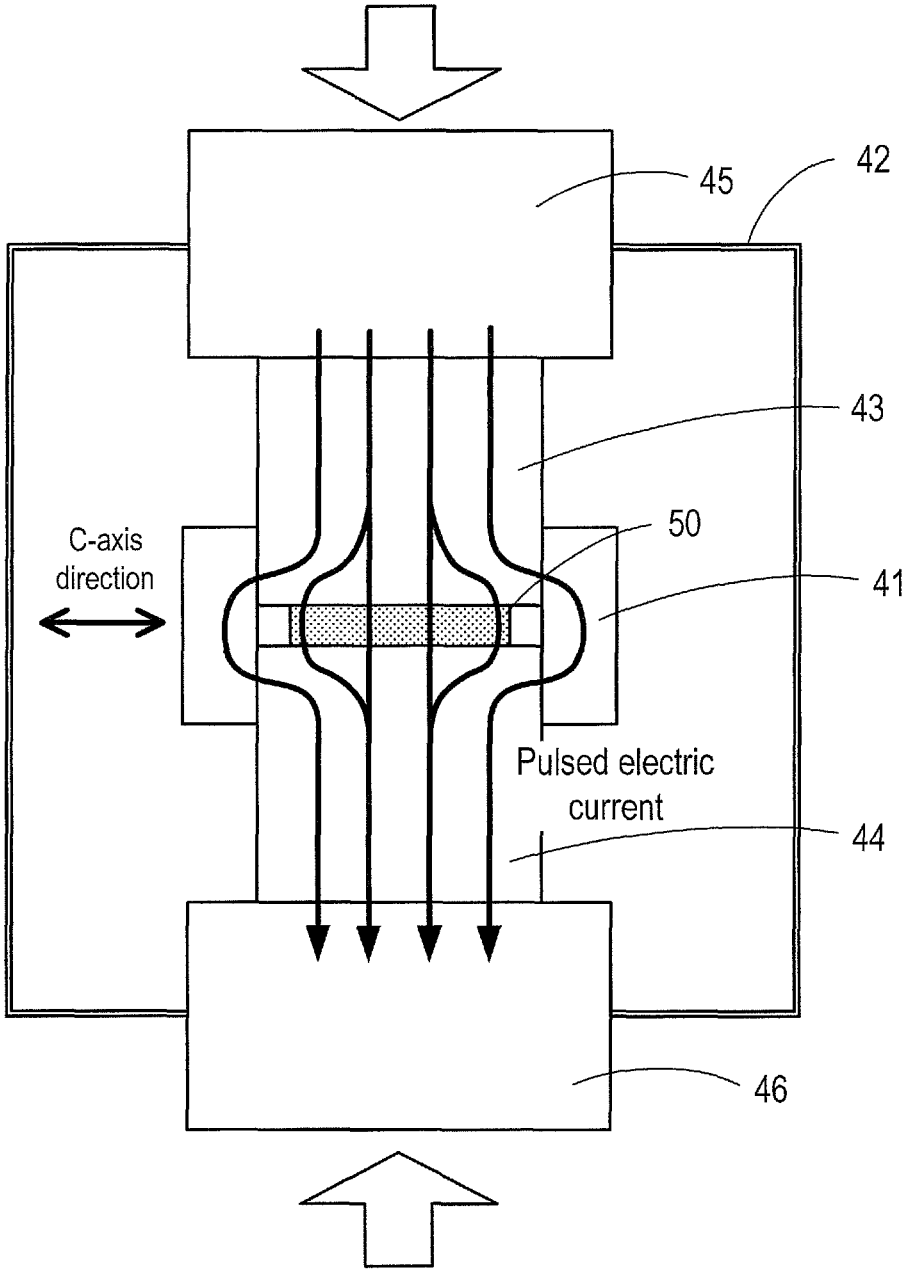
FIG. 8 is an explanatory diagram specifically illustrating the pressure sintering process of the sintered body in the manufacturing process of a permanent magnet according to the present invention.

Hereunder, the pressure sintering process of the sintered body 50 using the SPS sintering will be explained in more detail with referring to FIG. 8. FIG. 8 is a schematic diagram depicting the pressure sintering process of the sintered body 50 using the SPS sintering.

As depicted in FIG. 8, in the case that the SPS sintering is carried out, first, the sintered body 50 is put in a sintering die 41 which is made of graphite. Meanwhile, the sintered body 50 is put such that the pressure may be applied in a direction perpendicular to the direction of the applied magnetic field (for example, in-plane and machine direction of the green sheet). Then, the sintered body 50 put in the sintering die 41 is kept in a vacuum chamber 42, and an upper punch 43 and a lower punch 44, both being also made of graphite, are set thereat. Thereafter, by using an upper punch electrode 45 coupled to the upper punch 43 and a lower punch electrode 46 coupled to the lower punch 44, the pulsed DC voltage/current with a low voltage and a high current is applied. At the same time, by using a pressing mechanism (not illustrated), a load is applied to the upper punch 43 and the lower punch 44 from the upward and downward directions, respectively. As a result, the sintered body 50 put in the sintering die 41 is sintered while being pressed. Also, in order to improve the productivity, it is preferable to carry out the SPS sintering to a plurality of the shaped bodies (for example, 10 shaped bodies) simultaneously. Meanwhile, in the case that the SPS sintering is simultaneously carried out to a plurality of the sintered bodies 50, the plurality of the sintered bodies 50 may be put in one space, or each of the sintered bodies 50 may be put in different spaces. Meanwhile, in the case that the plurality of the sintered bodies 50 each are put in different sintering spaces, an embodiment is made such that the upper punch 43 and the lower punch 44 for pressing the sintered body 50 in each space may be integrated among each space (so that the pressure can be applied simultaneously to the plurality of the shaped bodies in each space by the upper punch 43 and the lower punch 44 which are integrally operated).

EXAMPLES

Hereunder, Examples of the present invention will be explained by comparing with Comparative Examples.

Example 1

In Example 1, an Nd—Fe—B-based magnet was used, wherein the alloy composition of Nd/Fe/B=32.7/65.96/1.34% by weight was selected. A compound was prepared by adding a binder to the magnet powder. Polyisobutylene (PIB) was used as the binder. Meanwhile, the addition amount of the binder relative to the magnet powder is 4 parts by mass. Further, the compound melted by heating was coated onto a substrate by a slot-die method so as to be molded to a green sheet having the thickness of 8 mm. While the green sheet thus molded was heated by a hot plate heated to 200° C. for 5 minutes, the magnetic field orientation was carried out by applying 12 T of a magnetic field in an in-plane and machine direction of the green sheet. Next, subsequent to the magnetic field orientation, the green sheet was punched into a prescribed shape, which was then calcined in a hydrogen atmosphere (temperature rising rate was 1.5° C./minute, and after reaching 450° C., the temperature was kept there for 5 hours); and then, the pressureless sintering thereof was carried out by the vacuum sintering. Thereafter, the sintered body which was sintered by the pressureless sintering was put in the sintering die of the SPS sintering equipment; and then, while the pressure of 10 kgf/cm$^2$ was applied in a direction perpendicular to the direction of the applied magnetic field, the pressure sintering was carried out by keeping the sintered body at 920° C. for 5 minutes. Meanwhile, other processes were the same as those previously described in "Method for Manufacturing Permanent Magnet".

Examples 2 and 3

The permanent magnets of these Examples were produced with the same conditions as those of Example 1.

Comparative Examples 1 to 3

The permanent magnets of these Examples each were produced only by sintering the shaped body with the pressureless sintering without carrying out the pressure sintering in Examples 1 to 3 (i.e., the permanent magnets before sintering the permanent magnets in Examples 1 to 3).

(Comparison Between Examples and Comparative Examples)

The density (%) and degree of orientation (%) of each magnet of Examples 1 to 3 and Comparative Examples 1 to 3 after sintering were measured. Also, the residual magnetic flux density (kG) and the coercive force (kOe) of each magnet of Examples 1 to 3 and Comparative Examples 1 to 3 were measured. Meanwhile, measurement of the degree of orientation was made by calculating Br/Jmax, wherein Br (residual magnetic flux density) and Jmax (maximum magnetization) were measured by using a direct current autorecording fluxmeter (TRF-5BH-25auto, manufactured by Toei Industry Co., Ltd.; the maximum applied magnetic field was 25 KOe). In FIG. 9, a table of the measurement results is illustrated.

When comparison is made as to the density between the permanent magnet of Example 1 and the permanent magnet of Comparative Example 1, the density of the permanent magnet of Comparative Example 1 in which the pressure sintering was not carried was 97%; on the other hand, the density of the permanent magnet of Example 1 in which the pressure sintering was carried out later was 99%, which is higher than the density of the permanent magnet of Comparative Example 1. That is, it is presumed that by further carrying out the pressure sintering after the pressureless sintering, the density of the magnet was improved. Meanwhile, as depicted in FIG. 9, the density of the permanent magnet has large effects to the magnetic properties thereof; and therefore, the permanent magnet of Example 1 having higher density illustrates higher values in the residual magnetic flux density and the coercive force. Meanwhile, it could be confirmed that sufficient magnetic properties could be expressed if the density was 95% or more. Further, even if the density of the permanent magnet after the pressureless sintering and before the pressure sintering were less than 95%, the density can be made 95% or more by carrying out the pressure sintering.

Also, when comparison is made as to the degree of orientation between the permanent magnet of Example 1 and the permanent magnet of Comparative Example 1, the degree of orientation of the permanent magnet after carrying out the pressure sintering (Example 1) did not decrease as compared to the degree of orientation of the permanent magnet before carrying out the pressure sintering (Comparative Example 1). That is, it can be seen that when the direction of the pressure applied in the pressure sintering process is made perpendicular to the direction of the applied magnetic field (namely, the direction of the C-axis (axis of easy magnetization) of the magnet particles orientated by the magnetic field orientation process), the direction of the C-axis (axis of easy magnetization) of the magnet particles does not change by the pressure applied to the sintered body, so that the highly orientated state can be maintained.

In Examples 2 and 3, too, the densities thereof are increased as compared with Comparative Examples 2 and 3; and the magnetic properties are improved as well. On the other hand, the degree of orientation thereof is not decreased.

As explained above, in the permanent magnet 1 and the method for manufacturing the permanent magnet 1 according to the present embodiment, the compound 12 is produced by milling the magnet raw material into the magnet powder followed by mixing the magnet powder thus milled with the binder. Then, the compound 12 thus produced is molded by a hot-melt molding to the green sheet 14 in the sheet-like shape on the supporting substrate 13. Thereafter, with heating the green sheet 14 thus molded so as to be softened, the magnetic field orientation is carried out by applying a magnetic field to the green sheet 14 thus heated, which is then followed by vacuum sintering of the green sheet 14 obtained after the magnetic field orientation, and this is further followed by pressure sintering thereof to obtain the permanent magnet 1. As a result, contract by sintering is so uniform that deformation such as warpage and depression do not take place after sintering; and moreover, pressure is not applied unevenly in the pressing process, so that there is no necessity of having a mending process which has been conventionally needed after sintering; and thus, the manufacturing process can be made simple. As a consequence, shaping to the permanent magnet with high size accuracy can be realized. In addition, even in the case that the permanent magnet film is made thin, increase in number of the process can be avoided without lowering a yield rate of materials. In addition, with heating the green sheet 14 thus molded, the magnetic field orientation is carried out by applying a magnetic field to the green sheet 14 thus heated; and therefore, even after the molding, the magnetic field orientation to the green sheet 14 can be made properly, and the magnetic properties of the permanent magnet can be improved. In addition, during the time of the magnetic field orientation, there is no risk of liquid localization, i.e., no risk of imbalance in the sheet thickness of the green sheet 14. In addition, the green sheet 14 is conveyed into a uniform magnetic field, and the viscosity of the binder contained therein becomes lower by heating, so that uniform C-axis orientation can be obtained only by the rotation torque in the uniform magnetic field. In addition, even when the green sheet 14 which has the thickness of more than 1 mm is formed, air bubbles are not formed and the binder is well intermingled, so that there is no risk of the interlayer-delamination in the binder removal process (calcination process). In addition, because the shaped body 40 is sintered further by the pressure sintering after the sintering thereof by the pressureless sintering, the density of the permanent magnet after sintering can be made high (full densification). In addition, because during the pressure sintering, a pressure is applied to the sintered body 50 in a direction of perpendicular to the direction of the applied magnetic field, application of the pressure to the sintered body 50 does not cause any change in the direction of the C-axis (axis of easy magnetization) of the magnet particles after orientation. Therefore, there is no risk of decrease in the degree of orientation, so that decrease in the magnetic properties can also be prevented from occurring.

In addition, in the step of sintering the sintered body 50 by the pressure sintering, the sintering is made by a uniaxial pressure sintering thereby leading to uniform contraction by sintering, so that deformation such as warpage and depression after sintering can be prevented from occurring. In addition, decrease in the degree of orientation can also be prevented from occurring.

In addition, in the step of sintering the sintered body 50 by the pressure sintering, the sintering is made by an electric current sintering, so that rapid heating and cooling are possible, and in addition, the sintering can be made in a low temperature range. As a result, the time of the temperature rise and the retention time thereof can be made short, so that a compact sintered body with suppressed grain growth of the magnet particles can be produced.

In addition, when the density of the rare-earth permanent magnet is made 95% or more, spaces are not formed inside the magnet so that a large decrease in the magnetic properties caused by the spaces can be avoided.

In addition, even in the case that the calcination process is carried out to the shaped body 40 for decarbonization, high density of the permanent magnet after sintering can be obtained.

In addition, because the shaped body 40 is calcined by keeping it at a predetermined temperature for a certain period of time after the temperature thereof is raised under a non-oxidizing atmosphere to the predetermined temperature with the temperature rising rate of 2° C./minute or less, the carbons contained in the shaped body 40 can be removed gradually in accordance with a slow change of the temperature. As a consequence, the rare-earth permanent magnet having high density can be produced without forming many spaces inside the magnet.

In addition, because the permanent magnet is composed of the magnet which is obtained by mixing the magnet powder with the binder and then sintering the molded green sheet 14, the sintering can be made with uniform contraction so that deformation such as warpage and depression do not take place after sintering; and moreover, pressure is not applied unevenly in the pressing process, so that there is no necessity of having a mending process which has been conventionally needed after sintering; and therefore, the manufacturing process can be made simple. As a consequence, the permanent magnet can be shaped with a high size accuracy.

Meanwhile, the present invention is not limited to Examples described above; and thus, it is a matter of course that various improvements and modifications can be made, provided that the scope thereof does not deviate from the gist of the present invention.

For example, milling conditions of the magnet powder, kneading conditions, molding conditions, the magnetic field orientation process, calcining conditions, sintering conditions, and the like are not limited to the conditions described in Examples described above. For example, in Examples described above, the magnet raw material is milled by a wet milling using a bead mill; however, milling by a dry milling using a jet mill may also be allowed. In addition, the atmosphere in the calcination process may be other than the hydrogen atmosphere (for example, a nitrogen atmosphere, a He atmosphere, an Ar atmosphere, or the like), provided that it is a non-oxidizing atmosphere. In Examples described above, the magnet is sintered by the SPS sintering; however, the magnet may also be sintered by other pressure sintering method (such as for example, a hot-press sintering). In addition, the calcination process may be omitted. In such a case, the decarbonization is carried out in the course of the sintering process.

In Examples described above, a resin, a long-chain hydrocarbon, or a fatty acid ester is used as the binder; but, other materials may be used as well.

In addition, the permanent magnet may also be produced by calcining and sintering a shaped body which is molded by a molding method other than the green sheet molding (for example, powder compaction molding). Even in such a case, full densification by carrying out the pressure sintering can be expected. In addition, in Examples described above, the calcination is carried out in a hydrogen atmosphere or in a mixed gas atmosphere of hydrogen and an inert gas after molding the magnet powder; however, an embodiment may also be allowed that the calcination process is carried out for the magnet powder before molding, then the magnet powder thus calcined is molded to a shaped body, and thereafter, the sintering is carried out to produce the permanent magnet. When the embodiment as described above is employed, because the calcination is carried out for the magnet particle in the form of powder, the surface area of the magnet to be calcined can be made larger as compared with the case that the calcination is carried out for the magnet particle after molding. That is, the carbons in the calcined body can be reduced more surely. However, in the case that molding is made to the green body, because the binder is thermally decomposed by the calcination process, the calcination process is preferably carried out after molding.

Further, in Examples described above, the heating process and the magnetic field orientation process of the green sheet 14 are simultaneously carried out; however, the magnetic field orientation process may be carried out after the heating process and before the green sheet 14 is solidified. Further, in the case that the magnetic field orientation is carried out before the coated green sheet 14 is solidified (that is, the green sheet 14 is in a softened state even without carrying out the heating process), the heating process may be omitted.

Further, in the Examples described above, the slot-die coating process, the heating process, and the magnetic field orientation process are consecutively carried out in a series. However, an embodiment that these processes are not carried out in the consecutive processes may also be allowed. Alternatively, an embodiment that the processes may be divided into two parts, the first part up to the coating process and the second part from the heating process and the processes that follow, and each of the two parts may be carried out consecutively. In such a case, an embodiment may be allowed that the green sheet 14 having been coated is cut at a prescribed length, and the green sheet 14 in a stationary state is heated and subjected to the magnetic field orientation by applying the magnetic field.

Description of the present invention has been given by taking the example of the Nd—Fe—B-based magnet. However, other kinds of magnets may be used (for example, samarium-based cobalt magnet, alnico magnet, and ferrite magnet). Further, in the alloy composition of the magnet in the present invention, the proportion of the Nd component is larger than that in the stoichiometric composition. However, also the proportion of the Nd component may be the same as in the stoichiometric composition.

DESCRIPTION OF REFERENCE NUMERALS AND SIGNS

1 permanent magnet
11 jet mill
12 compound
13 supporting substrate
14 green sheet
15 slot die
25 solenoid
26 hot plate
37 heating device
40 shaped body
50 sintered body

The invention claimed is:

1. A rare-earth permanent magnet, wherein the rare-earth permanent magnet is manufactured by a method comprising:
- milling a magnet raw material into magnet powder;
- forming a shaped body by molding the magnet powder thus milled;
- carrying out magnetic field orientation to the shaped body by applying a magnetic field;
- sintering the shaped body thus orientated in a magnetic field by a pressureless sintering; and
- sintering further a sintered body, which is the shaped body sintered by the pressureless sintering, by a pressure sintering wherein a pressure is applied in a perpendicular direction to an applied magnetic field direction.

2. The rare-earth permanent magnet according to claim 1, wherein in the step of sintering the sintered body by a pressure sintering, the sintering is made by a uniaxial pressure sintering.

3. The rare-earth permanent magnet according to claim 1, wherein in the step of sintering the sintered body by a pressure sintering, the sintering is made by an electric current sintering.

4. The rare-earth permanent magnet according to claim 1, wherein density of the rare-earth permanent magnet sintered by the pressure sintering is 95% or more.

5. The rare-earth permanent magnet according to claim 1, wherein before the pressureless sintering of the shaped body, the shaped body is calcined under a non-oxidizing atmosphere to remove carbons in the shaped body.

6. The rare-earth permanent magnet according to claim 5, wherein in the step of calcining the shaped body, after a temperature of the shaped body is raised to a predetermined temperature under a non-oxidizing atmosphere with a temperature rising rate of 2° C./minute or less, the shaped body is kept at the predetermined temperature for a certain period of time.

7. The rare-earth permanent magnet according to claim 1, wherein in the step of molding the magnet powder to a shaped body, a mixture of the magnet powder with a binder is formed, and then the mixture is molded to a sheet-like shape to produce a green sheet as the shaped body.

8. The rare-earth permanent magnet according to claim 1, wherein in the step of molding the magnet powder to a shaped body, the magnet powder is molded to the shaped body by a powder compaction molding.

9. A method for manufacturing a rare-earth permanent magnet, the method comprising:

milling a magnet raw material into magnet powder;

forming a shaped body by molding the magnet powder thus milled;

carrying out magnetic field orientation to the shaped body by applying a magnetic field;

sintering the shaped body thus orientated in a magnetic field by a pressureless sintering; and sintering further a sintered body, which is the shaped body sintered by the pressureless sintering, by a pressure sintering wherein a pressure is applied in a perpendicular direction to an applied magnetic field direction.

10. The method for manufacturing a rare-earth permanent magnet according to claim 9, wherein in the step of sintering the sintered body by a pressure sintering, the sintering is made by a uniaxial pressure sintering.

11. The method for manufacturing a rare-earth permanent magnet according to claim 9, wherein in the step of sintering the sintered body by a pressure sintering, the sintering is made by an electric current sintering.

12. The method for manufacturing a rare-earth permanent magnet according claim 9, wherein density of the rare-earth permanent magnet sintered by the pressure sintering is 95% or more.

13. The method for manufacturing a rare-earth permanent magnet according to claim 9, wherein before the pressureless sintering of the shaped body, the shaped body is calcined under a non-oxidizing atmosphere to remove carbons in the shaped body.

14. The method for manufacturing a rare-earth permanent magnet according to claim 13, wherein in the step of calcining the shaped body, after a temperature of the shaped body is raised to a predetermined temperature under a non-oxidizing atmosphere with a temperature rising rate of 2° C./minute or less, the shaped body is kept at the predetermined temperature for a certain period of time.

15. The method for manufacturing a rare-earth permanent magnet according to claim 9, wherein in the step of molding the magnet powder to a shaped body, a mixture of the magnet powder with a binder is formed, and then the mixture is molded to a sheet-like shape to produce a green sheet as the shaped body.

16. The method for manufacturing a rare-earth permanent magnet according claim 9, wherein in the step of molding the magnet powder to a shaped body, the magnet powder is molded to the shaped body by a powder compaction molding.

* * * * *